US009746278B1

(12) United States Patent
Chang

(10) Patent No.: US 9,746,278 B1
(45) Date of Patent: Aug. 29, 2017

(54) CROSSBOW WITH A ROBUST MULTI-FUNCTIONAL STRING-PULLING UNIT

(71) Applicant: Combis Sport Enterprise Co., Ltd., Taichung (TW)

(72) Inventor: Chu-Wei Chang, Taichung (TW)

(73) Assignee: Combis Sport Enterprise Co., Ltd., Taichung (TW)

( * ) Notice: Subject to any disclaimer, the term of this patent is extended or adjusted under 35 U.S.C. 154(b) by 0 days.

(21) Appl. No.: 15/371,303

(22) Filed: Dec. 7, 2016

(51) Int. Cl.
*F41B 5/12* (2006.01)
*F41B 5/14* (2006.01)
*F41G 1/467* (2006.01)

(52) U.S. Cl.
CPC ..... *F41B 5/1469* (2013.01); *F41B 5/12* (2013.01); *F41G 1/467* (2013.01)

(58) Field of Classification Search
CPC ..... F41B 5/12; F41B 5/123
See application file for complete search history.

(56) References Cited

U.S. PATENT DOCUMENTS 3,670,711 A * 6/1972 Firestone ..... F41B 5/12 124/25
4,827,894 A * 5/1989 Schallberger ..... F41B 5/12 124/25
5,215,069 A * 6/1993 Liu ..... F41B 5/12 124/25
5,823,172 A * 10/1998 Suggitt ..... F41B 5/12 124/25
6,705,304 B1 * 3/2004 Pauluhn ..... F41B 5/12 124/25
7,100,590 B2 * 9/2006 Chang ..... F41B 5/1469 124/25

FOREIGN PATENT DOCUMENTS

TW 207344 6/1993

* cited by examiner

*Primary Examiner* — John Ricci
(74) *Attorney, Agent, or Firm* — Alan D. Kamrath; Kamrath IP Lawfirm, P.A.

(57) ABSTRACT

A crossbow includes a barrel, a wing supported on a front portion of the barrel, a string connected to the wing at two ends, a rear sight supported on a rear portion of the barrel, and a string-pulling unit movably supported on the barrel and adapted for pulling the string backward on the barrel. The string-pulling unit includes two parallel shanks, a handle and a crossbar. The shanks are movable along two parallel lateral faces of the barrel. The handle is connected to the shanks near a rear end of each of the shanks. The crossbar is connected to the shanks near a front end of each of the shanks and adapted for keeping the shanks in position relative to each other. Moreover, the crossbar extends over the barrel. A front sight is formed on the crossbar and adapted for cooperation with the rear sight during aiming.

5 Claims, 4 Drawing Sheets

CROSSBOW WITH A ROBUST MULTI-FUNCTIONAL STRING-PULLING UNIT

BACKGROUND OF INVENTION

1. Field of Invention

The present invention relates to a crossbow and, more particularly, to a crossbow with a robust multi-functional string-pulling unit.

2. Related Prior Art

Taiwanese Patent No. 207344 discloses a crossbow that includes a barrel 10, a wing (not shown) supported on a front portion of the barrel 10, a string (not shown) connected to the wing at two ends, a string-pulling unit 14 supported on the barrel 10, and a trigger 16 connected to the barrel 10. A front sight is supported on a front portion of the barrel 10 while a rear sight is supported on a rear portion of the barrel 10. The string-pulling unit 14 is operable to pull the string to a tight, stressed or loaded status. The trigger 16 is operable to lock or release the string. The string-pulling unit 14 is a substantially U-shaped element made by bending a metal wire or a metal strip. The string-pulling unit 14 includes two shanks each including a crook end 141 for hooking the string.

There are several problems have been encountered in the use of this crossbow. Firstly, biased by the string, the shanks of the string-pulling unit 14 tend to rub the barrel 10 in operation. Such abrasion is harmful for both of the string-pulling unit 14 and the barrel. Moreover, the abrasion causes trouble for an archer who tries to load the crossbow. Secondly, the user can load the crossbow with a bolt or pivot the trigger to release the string before the string-pulling unit is returned to the original position. Hence, there are concerns about the security of the crossbow. Thirdly, the front sight is used for only one purpose.

The present invention is therefore intended to obviate or at least alleviate the problems encountered in prior art.

SUMMARY OF INVENTION

It is the primary objective of the present invention to provide a crossbow with a robust multi-functional string-pulling unit.

To achieve the foregoing objective, the string-pulling unit includes two parallel shanks, a handle and a crossbar. The shanks are movable along two parallel lateral faces of the barrel. The handle is connected to the shanks near a rear end of each of the shanks. The crossbar is connected to the shanks near a front end of each of the shanks and adapted for keeping the shanks in position relative to each other. Moreover, the crossbar extends over the barrel. A front sight is formed on the crossbar and adapted for cooperation with the rear sight during aiming.

Other objectives, advantages and features of the present invention will be apparent from the following description referring to the attached drawings.

BRIEF DESCRIPTION OF DRAWINGS

The present invention will be described via detailed illustration of the preferred embodiment referring to the drawings wherein.

DETAILED DESCRIPTION OF PREFERRED EMBODIMENT

Figure 1:
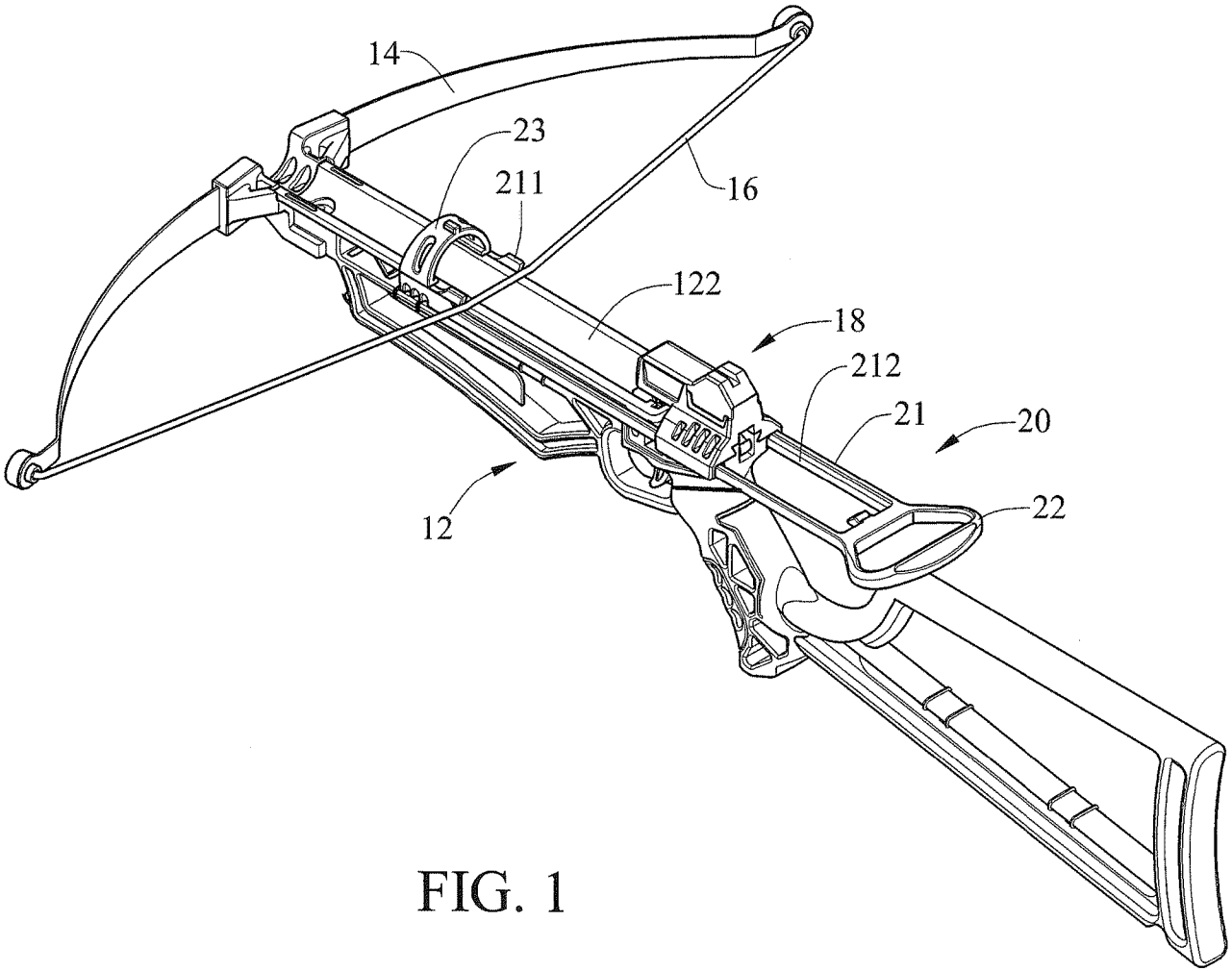
FIG. 1 is a perspective view of a crossbow according to the preferred embodiment of the present invention.
Figure 2:
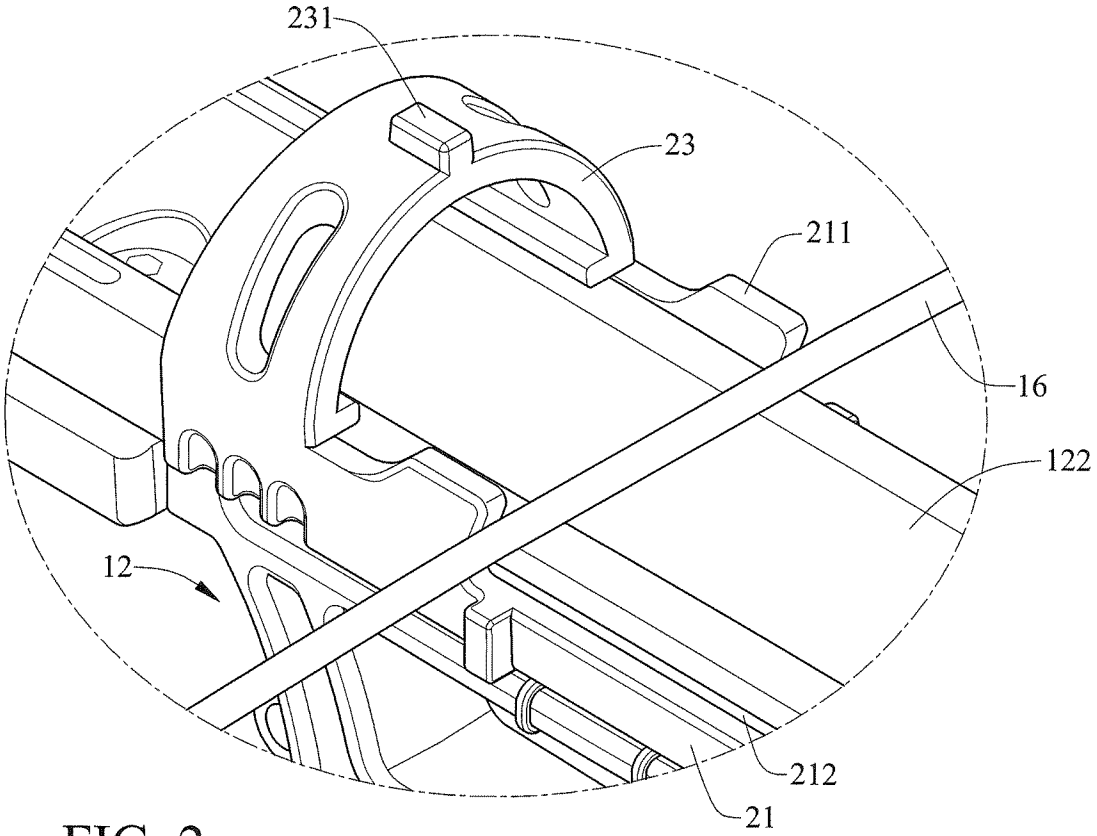
FIG. 2 is an enlarged partial perspective view of the crossbow shown in FIG. 1.
Figure 3:
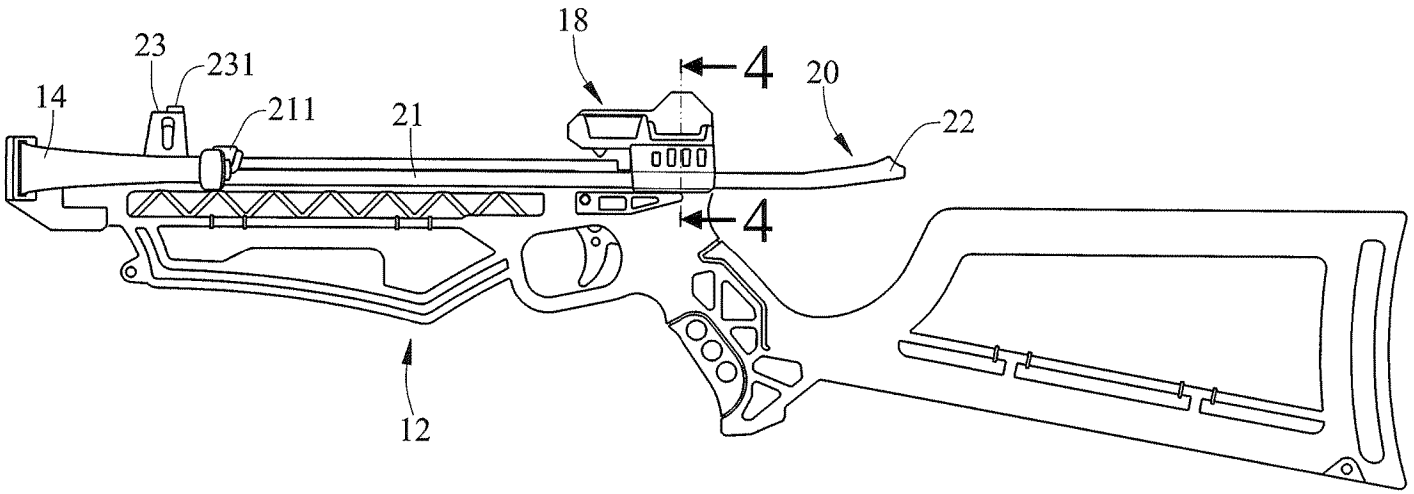
FIG. 3 is a side view of the crossbow shown in FIG. 1.
Figure 4:
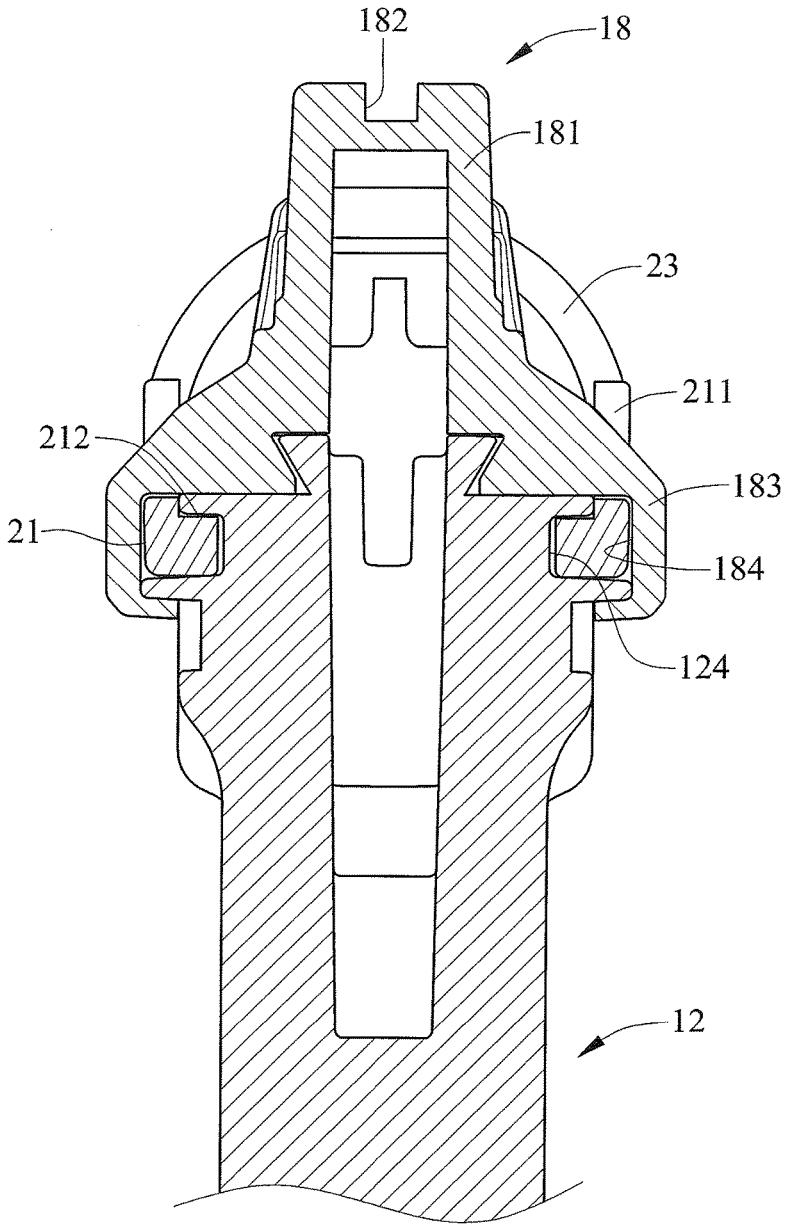
FIG. 4 is a cross-sectional view of the crossbow taken along a line 4-4 shown in FIG. 1.

Referring to FIGS. 1 to 4, a crossbow includes a barrel 12, a wing 14, a string 16, a rear sight 18 and a string-pulling unit 20 in accordance with the preferred embodiment of the present invention. The barrel 12 includes a flight groove 122 and two grooves 124. The flight groove 122 extends in and along an upper face of the barrel 12. Each of the grooves 124 extends in and along a corresponding one of two parallel lateral faces of the barrel 12.

The wing 14 is substantially transversely supported on a front portion of the barrel 12. The wing 14 includes two limbs each extending on a side of the barrel 12.

The string 16 is tied to the wing 14. The string 16 includes two ends each tied to an end of the wing 14.

The rear sight 18 is placed on a rear portion of the barrel 12. The rear sight 18 includes a block 181, a sight recess 182, two parallel shields 183 and two grooves 184. The sight recess 182 is made in an upper face of the block 181. The shields 183 extend from a lower face of the block 181. The shields 183 cover the grooves 124 when the rear sight 18 is supported on the barrel 12. Each of the grooves 184 extends in a lateral face of a corresponding one of the shields 183 so that each of the grooves 184 faces a corresponding one of the grooves 124.

The string-pulling unit 20 is operable to pull the string 16 rearward along the barrel 12. The string-pulling unit 20 includes two parallel shanks 21, a handle 22 connected to the shanks 21, and a crossbar 23 connected to the shanks 21. Each of the shanks 21 includes an internal portion movably inserted in a corresponding one of the grooves 124 and an external portion movably inserted in a corresponding one of the grooves 184. The handle 22 can be operated to move the shanks 21 along the barrel 12, forward or rearward. Each of the shanks 21 is formed with a barb 211 formed at a front end and adapted for hooking the string 16.

Preferably, each of the shanks 21 includes a rib 212 extending on and along the internal portion. The rib 212 of each of the shanks 21 is movably inserted in a corresponding one of the grooves 124. The string-pulling unit 20 can be smoothly moved along the barrel 12 because the ribs 212 of the shanks 21 are movably inserted in the grooves 124 of the barrel 12.

The crossbar 23 includes two ends each connected to a front end of a corresponding one of the shanks 21. The crossbar 23 extends across and over the barrel 12 when the string-puling unit 20 is supported on the barrel 12. The crossbar 23 keeps the front ends of the shanks 21 in position relative to each other, even when the shanks 21 is subject to a force exerted by the string 16. The crossbar 23 includes a front sight 231 formed thereon. A target, the front sight 231 and the sight recess 182 of the rear sight 18 should be a line when the crossbow is aimed at the target.

A user can operate the handle 22 of the string-pulling unit 20 to move the shanks 21 along the barrel 12. In the movement, each of the shanks 21 is sandwiched between the internal face of a corresponding one of the shields 183 of the rear sight 18 and a corresponding one of the lateral faces of the barrel 12 so that the shanks 21 remain parallel to each other. The movement is smooth because the movement of the ribs 212 of the shanks 21 in the grooves 124 of the barrel 12 is smooth.

The string 16 is pulled toward the barrel 12 by the barbs 211 of the string-pulling unit 20 as the shanks 21 of the string-pulling unit 20 are moved rearward along the barrel 12. The shanks 21 are subjected to forces exerted by the string 16. The forces tend to bend the shanks 21 toward each other. However, the shanks 21 remain parallel to each other against the forces because they are supported by the crossbar 23. The strength of the string-pulling unit 20 is enhanced by the use of the crossbar 23 of the shanks 21. The string-pulling unit 20 can be moved forward along the barrel 12 and returned to the original position after the string 16 is brought into engagement with a trigger (not numbered) by the string-pulling unit 20.

The crossbar 23 is moved forward along and over the barrel 12 when the string-pulling unit 20, which includes the shanks 21 and the crossbar 23, is moved forward to the original position. The crossbar 23 would interfere with a bolt should the bolt be loaded in the flight groove 122 during the forward movement thereof. Hence, premature loading of a bolt in the flight groove 122 before the string-pulling unit 20 is returned to the original position is avoided.

Moreover, the front sight 231 is formed on the crossbar 23 and used together with the rear sight 18 for aiming. Thus, there is no need to provide a front sight directly on the barrel 12 that would otherwise involves a complicated structure.

The present invention has been described via illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A crossbow comprising a barrel (12), a wing (14) supported on a front portion of the barrel (12), a string (16) connected to the wing (14) at two ends, a rear sight (18) supported on a rear portion of the barrel (12), and a string-pulling unit (20) movably supported on the barrel (12) and adapted for pulling the string (16) backward on the barrel (12), the crossbow being characterized by that the string-pulling unit (20) comprises:

two parallel shanks (21) movable along two parallel lateral faces of the barrel (12);

a handle (22) connected to the shanks (21) near a rear end of each of the shanks (21);

a crossbar (23) connected to the shanks (21) near a front end of each of the shanks (21), adapted for keeping the shanks (21) in position relative to each other, and extending over the barrel (12); and a front sight (231) formed on the crossbar (23) and adapted for cooperation with the rear sight (18) during aiming.

2. The crossbow according to claim 1, wherein the barrel (12) further comprises grooves (124) each extending in a lateral face thereof, and each of the shanks (21) comprises a rib (212) movably inserted in a corresponding one of the grooves (124).

3. The crossbow according to claim 2, wherein the rear sight (18) comprises:

a block (181); and two shields (183) extending from a lower face of the block (181) and adapted for covering the grooves (124) of the barrel (12).

4. The crossbow according to claim 3, wherein each of the shields (183) comprises a groove (184) for receiving a corresponding one of the shanks (21).

5. The crossbow according to claim 1, wherein the rear sight (18) comprises a sight recess (182) made in an upper face and adapted for alignment with the front sight (231) and a target.

* * * * *